US005614850A

United States Patent [19]

Corsi et al.

[11] Patent Number: 5,614,850

[45] Date of Patent: Mar. 25, 1997

[54] CURRENT SENSING CIRCUIT AND METHOD

[75] Inventors: Marco Corsi, Dallas, Tex.; Gabriel A. Rincon, Margate, Fla.

[73] Assignee: Texas Instruments Incorporated, Dallas, Tex.

[21] Appl. No.: 353,488

[22] Filed: Dec. 9, 1994

[51] Int. Cl.[6] ..... G05F 1/10

[52] U.S. Cl. ..... 327/55; 327/538; 327/543; 327/545

[58] Field of Search ..... 327/538, 540, 327/541, 543, 545, 546, 54, 55, 67, 87, 99; 323/313, 315, 316

[56] References Cited

U.S. PATENT DOCUMENTS

| | | | |
|---|---|---|---|
| 4,870,299 | 9/1989 | Chen | 327/99 |
| 4,965,524 | 10/1990 | Patchen | 327/99 |
| 5,151,613 | 9/1992 | Satou et al. | 327/99 |
| 5,432,432 | 7/1995 | Kimura | 323/313 |
| 5,448,597 | 9/1995 | Hashimoto | 327/99 |
| 5,486,785 | 1/1996 | Blankenship | 327/540 |

OTHER PUBLICATIONS

Analogue IC Design: The Current–Mode Approach edited by C. Toumazou, F.J. Lidgey & D.G. Haigh (paper by Barry Gilbert, see p. 70 ff.) pp. 10–90.

*Primary Examiner*—Terry Cunningham

*Attorney, Agent, or Firm*—Warren L. Franz; Mark E. Courtney; Richard L. Donaldson

[57] ABSTRACT

A circuit and method for sensing and limiting current. An output driving transistor (M1) is coupled between a circuit output terminal and a power supply terminal. A replicator circuit is formed in a cross-coupled quad configuration from bipolar transistors (Q11, Q12, Q13 and Q14) and is coupled to a second transistor (M2) which generals a voltage proportional to the current flowing in the output driving transistor (M1). The current sensing circuit generates an output current which is proportional to the current flowing in the output driving transistor multiplied by a ratio of the sizes of the second transistor and the output driving transistor. In a current limiting configuration, the output of the cross-coupled quad is used to reset a flip-flop (FF1) that drives the gate terminal of the output transistor (M1), thus shutting down the output transistor before it is damaged due to excess current. The circuitry of the invention may be applied to a high side driver or a low side driver output circuit. Other embodiments are also described.

26 Claims, 1 Drawing Sheet

CURRENT SENSING CIRCUIT AND METHOD

CROSS REFERENCE TO RELATED APPLICATION

This application relates to U.S. patent application Ser. No. 08/349,168, filed Dec. 1, 1994, (now U.S. Pat. No. 5,519,341), entitled "Current Sensing Circuit and Method", and assigned to Texas Instruments Incorporated.

FIELD OF THE INVENTION

This invention relates generally to the field of integrated circuits and the sensing and limiting of currents on integrated circuits, and specifically to the use of the on-resistance characteristic of an FET transistor to sense the value of currents flowing in an output transistor on the integrated circuit.

BACKGROUND OF THE INVENTION

In integrated circuits, it is often desirable to monitor the current being driven through a particular device. For example, an output transistor may require current limiting to protect the integrated circuit in the event that a fault develops in the external circuit. As another example, some implementations of switch-mode power controllers require a measure of inductor current as an input to the control circuitry. These applications, as well as many others, require that the current through a particular device of the integrated circuit be monitored. Often the current through a FET transistor must be monitored to provide the desired functionality.

Various prior art approaches to this problem exist. FIGS. 1 and 2 are schematics of two prior art current sensing circuits. In FIG. 1, transistor M1 is an NMOS power transistor which is connected between the low-potential side of a load at terminal OUT and ground. This configuration is usually called a low-side-drive (hereinafter LSD) configuration. The NMOS transistor M1, when enabled by a voltage at the circuit input terminal VIN, will pull output terminal OUT to a low voltage. A small resistor R1 is inserted between M1's source and ground. The voltage V1 developed across resistor R1 is simply:

$$V1=IL\cdot R1. \quad [1]$$

Thus the resistor is used to generate a voltage proportional to the current flowing in the output transistor M1. Stated another way, the resistor R1 is a current sensor. The circuit of FIG. 1 can be coupled to a comparator to create a current limiting circuit. The disadvantages of using the current sensing scheme of FIG. 1 in an integrated circuit are well known. Building precise resistors is very difficult in most process technologies used in fabricating semiconductor devices. Further, the resistor should preferably be of a fairly low value so as to limit unnecessary power dissipation. Building low value resistors is also difficult or impractical, particularly if matching to a higher-value resistor is also required.

Current sense resistors, such as are used in the circuit of FIG. 1, are not desirable components. They introduce Ohmic losses which would otherwise have been avoided, and they are often difficult to construct. Even if metal resistors are used, a substantial number of squares of metal may be required to form the current sense element. The ideal current limit circuit would require no current sense resistor.

For FET transistors, it is possible to use the inherent on-resistance of the transistor as a sense element. To understand why this is so, consider the Shichman-Hodges equation for a MOS transistor in the triode (or linear) region:

$$Id=k\cdot(Vgs-Vt-Vds/2)\cdot Vds \ (Vds<Vgs-Vt) \quad [2]$$

where $k=k'\cdot(W/L)$.

For most applications where a power MOS transistor is used as a switch, the voltage across the transistor will be quite small relative to the voltage (Vgs–Vt). This not only ensures operation in the triode region, but it also allows the term Vds/2 to be neglected in equation [2], simplifying the square-law equation to a linear equation of the form:

$$Id\approx k\cdot(Vgs-Vt)\cdot Vds \ (Vds<<Vgs-Vt) \quad [3]$$

The on-resistance of the transistor, $Rds_{on}$, is merely the ratio Vds/Id, which leads to the approximate formula for $Rds_{on}$:

$$Rds_{on}\approx 1/(k\cdot(Vgs-Vt)) \quad [4]$$

Obviously the variabilities inherent in the on-resistance $Rds_{on}$ of equation [4] are formidable. Both k and Vt vary with process and temperature, and Vgs is dependent upon the gate drive voltage supplied to the transistor. As a result, $Rds_{on}$ is not even approximately constant. Various schemes have been used to attempt to compensate for these variations.

A prior art current sensing circuit which attempts to solve the problems of the circuit of FIG. 1 by using the transistor on-resistance instead of a sensing resistor is depicted in FIG. 2. In the circuit of FIG. 2, the process and temperature dependent variabilities inherent in $Rds_{on}$ are handled by matching the $Rds_{on}$ of the power device to the $Rds_{on}$ of a reference device, which is preferably buried within the power device structure. Thermal matching is maximized by using similar devices which are in close physical proximity and therefore subject to the same process and temperature conditions.

In FIG. 2, NMOS output driving transistor M1 is again configured as a low side drive circuit. Any FET transistor can be used. When a positive voltage is applied at circuit input terminal VIN, the output terminal OUT will be pulled down to a low voltage. An operational amplifier (hereinafter op-amp) 2 is coupled to the voltage V1 at the output terminal OUT. This op-amp is set up in a unity gain configuration from node V1 to node V2. Transistor M3 is coupled to a current output IA. Transistor M2 is an FET transistor which matches M1, in other words it has similar device parameters and characteristics and it is assumed M2 has the same gate-to-source voltage Vgs as M1. Transistor M2 is used to sense the current flowing in the output transistor M1.

Because the voltages at nodes V1 and V2 are proportional to the currents flowing through the transistors M1 and M2, the voltages may be stated as:

$$V1=IL\cdot Rds_{M1}$$

$$V2=IA\cdot Rds_{M2} \quad [5]$$

where the on resistance Rdson for a transistor is proportional to the length to width ratio (L/W). It is clear also that $$V1=V2 \quad [6]$$

because of the operation of op-amp 2. Since it is also true that M2 and M1 are matched transistors, it can be stated that $$IA=IL\cdot[(Rds_{M1})/(Rds_{M2})]=IL\cdot[(L/W)_{M1}/(L/W)_{M2}] \quad [7]$$

The disadvantages with the scheme of FIG. 2 are that the circuit requires the use of an op amp circuit. These circuits are quite complex and involve many components. The operational amplifier has a relatively low bandwidth, consumes power, and the area required to implement it is high. The operational amplifier is therefore not ideal for integration with other circuitry.

The current sensing schemes of the prior art have limitations that make them unattractive for integrated circuit applications. Thus there is a need for an improved current sensing scheme for use in power integrated circuits and systems.

SUMMARY OF THE INVENTION

A current sensing circuit and method for an output driver is described. A cross-coupled quad replicator circuit constructed of bipolar transistors having equal emitter areas is coupled to an output driving transistor and to a matched, scaled sensing transistor. The cross-coupled quad circuit has an output current that is proportional to the current flowing through the output transistor. Because the sensing element is a transistor having similar process dependencies to the driving transistor, the circuit is largely independent of process and temperature variations. No specialized sensing resistor is required and thus the current sensing circuit is easily implemented in standard BiCMOS processes, and is compatible with linear, digital and mixed signal integrated circuits. The current sensing circuit may be implemented as a comparator. A current limiting circuit that will shut down the output driving transistor when the current flowing in the sensing transistor exceeds a threshold is also described.

BRIEF DESCRIPTION OF THE DRAWINGS

Corresponding numerals are used for corresponding elements in the drawings, unless otherwise indicated in the text.

DETAILED DESCRIPTION OF PREFERRED EMBODIMENTS

Figure 3:
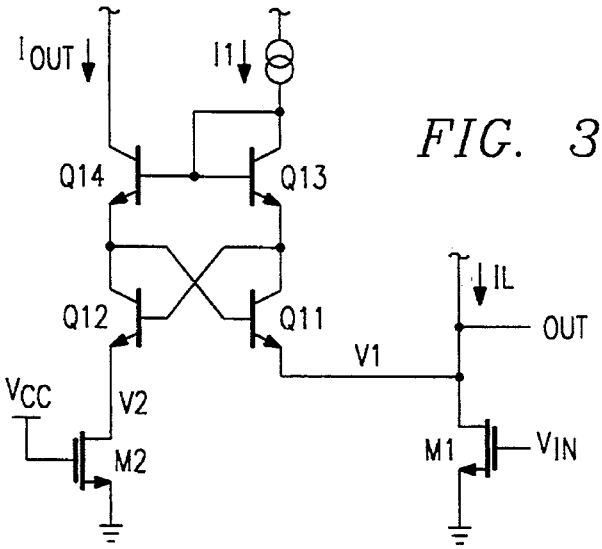
FIG. 3 depicts a schematic of a low side driver embodiment of a current sensing circuit incorporating the invention.

FIG. 3 depicts a current sensing circuit incorporating the invention. Output driving transistor M1 is configured as a low side driver circuit, and when the gate of M1 is at a high voltage, the voltage at the terminal OUT will be pulled to a low voltage just above ground. Voltage V1 is then the voltage across output driver Mi. A transistor M2 is used to sense the current flowing in the circuit. In this example, M1 and M2 are matched NMOS devices, but any FET transistors can be used. A cross-coupled quad replicator circuit is coupled to voltage nodes V1 and V2 and consists of four bipolar transistors Q11, Q12, Q13 and Q14. The cross-coupled quad is essentially a balanced circuit.

A simple analysis of the cross-coupled quad circuit can be made by examining the base-emitter voltage drops for each transistor 11–14 and writing an expression for the voltage at nodes V1 and V2 in FIG. 3 in terms of the base-emitter voltages Vbe for each transistor, as:

$$V1-V2=Vbe12+Vbe13-Vbe11-Vbe14 \quad [8]$$

Because the emitter areas of the bipolar transistors Qll–Q14 are equal, they will produce equal base emitter voltages Vbe for equal currents. Neglecting the base current errors, the current Iout flowing in transistors Q12 and Q14 is equal, and the current I1 flowing in transistors Q11 and Q13 is equal, the base emitter voltages Vbe for transistors Q12 and Q14 are equal, and the base emitter voltages Vbe for transistors Q11 and Q13 are equal, so equation [8] becomes:

$$V1-V2=0 \quad [9]$$

Thus the voltages V1 and V2 are necessarily equal when the circuit is in balance. The cross-coupled quad circuit of transistors Q11–Q14 replicates the voltage V1 at node V2, across transistor M2.

The circuit of FIG. 3 uses a reference device M2 to compensate for variations in power device MI. M2's gate is connected to the same supply which will drive the gate of M1 when this gate is turned on, and so the gate-source voltage Vgs of the two transistors match. The intrinsic transconductance k' and threshold voltage Vt of both transistors will also match, as they are fabricated on the same substrate and laid out in a manner that maximizes matching.

Voltages V1 and V2 will be equal, even if the currents flowing down the two sides of the cross-coupled quads are not equal. A current source I1 is used to bias transistors Q13 and Q11 to a convenient current level. The current level through transistors Q12 and Q14 is set by $V2/Rds_{on}(M2)$. Assuming that IL>>I1, so that I1 does not appreciably alter the current flowing in M1, then voltage V1 is simply $IL*Rdson_{M1}$. From this information, current Iout from this circuit can be computed:

$$Iout=(Rsdson_{M1}/Rdson_{M2})\cdot IL \quad [10]$$

Assuming that k=(W/L)k' for an MOS transistor where W and L are the effective channel width and length, and k' is the device's intrinsic transconductance, then equation [10]can be expanded using equation [7]to form:

$$Iout=[(W/L)_{M2}/(W/L)_{M1}]\cdot IL \quad [11]$$

Figure 1:
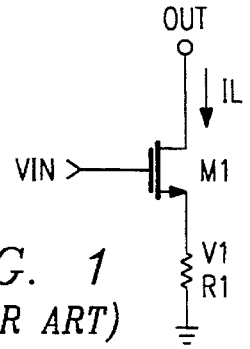
FIG. 1 (PRIOR ART)
FIG. 1 (prior art) depicts a schematic of a first current sensing circuit for a low side driver.
Figure 2:
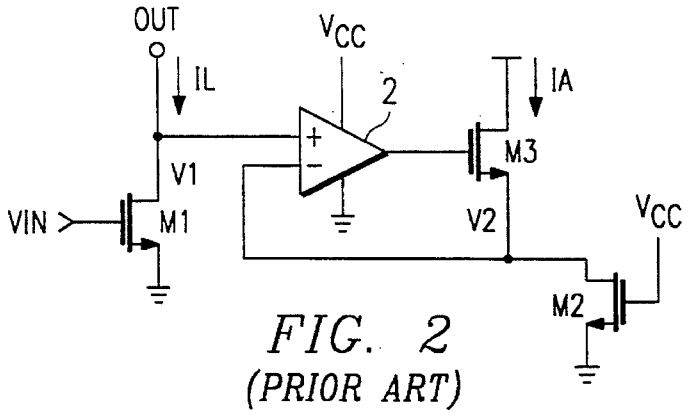
FIG. 2 (PRIOR ART)
FIG. 2 (prior art) depicts a schematic of a second current sensing circuit for a low side driver.

The result of this analysis is that the output current Iout of the circuit of FIG. 3 is directly proportional to the current IL through the load and power transistor M1, multiplied by the ratio of the sizes of transistors M2 and M1. Put another way, the cross-coupled quad replicates the current IL at the output Iout. Because no resistor is used in sensing the current, there is no problem integrating this circuit into a standard linear BiCMOS process. Also, since the transistors M1 and M2 will be built using the same process they will have the same process dependencies. The ratio of equation [11]will cancel out these variations and the circuit is practically independent of process variations. The circuit of FIG. 3. is advantageous over the prior art circuit of FIG. 2 in that the bandwidth of the circuit of FIG. 3 is higher, the number of components is substantially less, and the power and area used are less. The circuit of FIG. 3 is easily integrated into standard BiCMOS semiconductor process technologies.

Figure 4:
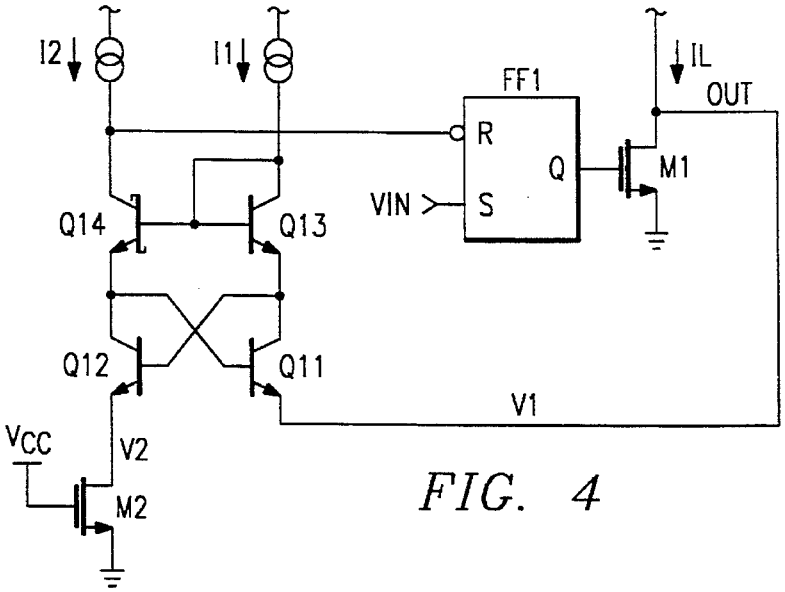
FIG. 4 depicts a schematic of a low side driver embodiment of a current limiting circuit incorporating the current sensing circuit of FIG. 3.

The circuit of FIG. 3 can be used in a current limiting configuration. FIG. 4 depicts a special case of the circuit of FIG. 3 incorporated into a current limiting circuit in the form of an improved emitter-side comparator. In FIG. 4, the cross-coupled quad circuit is set up exactly as in FIG. 3, with M1 acting as the drive transistor for a low side drive configuration output driver, M2 is the sense transistor which is used to sense the current flowing in the output transistor as described above, and current sources I2 and I1 are used to bias the cross-coupled quad transistors Qll–Q14. FF1 is a set-reset flip-flop with its set terminal coupled to an input VIN, and the reset terminal coupled to the collector of Q14. The flip-flop FF1 is shown only as an example, and any circuitry which allows the gate of M1 to be controlled when an overcurrent situation is detected by the cross-coupled quad circuit and the sense transistor can be used in place of FF1.

In operation, a pulse on the VIN terminal will set the flip-flop FF1 to enable the output transistor M1 to start pulling down the output terminal OUT. The current flowing through the output transistor will affect the voltage at V1, as before. The current flowing through M2 will increase as the current flowing through M1 increases, since the emitter areas are again equal and the difference V1–V2=0, as in [9]above.

In operation, the cross-coupled quad acts as a balanced circuit. When the balance is achieved, the relationship shown above exists between nodes V1 and V2, that is:

$$V1=V2 \quad [12]$$

V2 is the voltage due to current flowing in the sense transistor M2, which will be equal to the current supplied by current source I2 at the trip point, so:

$$V2=I2\cdot Rdson_{M2} \quad [13]$$

The voltage across M1 is computed assuming that the current IL >>I1, $$V1=IL\cdot Rdson_{M1} \quad [14]$$

Since the cross-coupled quad circuit will attempt to keep V1=V2, a threshold current value for IL can be defined as Ithreshold, the current where the balance exists:

$$Ithreshold=I2\cdot[Rdson_{M2}/Rdson_{M1}] \quad [15]$$

As the output current IL rises, so does the current flowing in transistor M2. When this current exceeds the current provided by current source I2, the collector of transistor Q14 will drop to a low voltage. The active low reset input of the flip-flop FF1 will be asserted, FF1 will reset and the gate of transistor M1 will be disabled, preventing damage to M1. To prevent charge storage delays associated with the saturation of transistor Q14 from slowing the response of the circuit, transistor Q14 is a Schottky diode clamped transistor, as indicated by the Schottky transistor symbol for Q14 in the figure. The designer can select the threshold current using equation [15]. The transistor size ratio enables the use of scaling between M1 and M2, so the current I2 can be substantially smaller than the current IL, which alleviates power consumption by the circuitry.

The circuits of FIGS. 3 and 4 can each be directly extended to a high side driver version using PNP transistors. Since the cross-coupled quad comparator uses devices with matched emitter areas, whatever nonideality factor the high level injection mechanisms of lateral PNPs could cause is canceled out. The result is that a high side driver version of the current sensing circuit of FIG. 3 which is made up of lateral PNP transistors in the cross-coupled quad comparator will work quite precisely in spite of the high level injection problems, although the speed of the circuit will be somewhat slower than the NPN version due to larger device capacitances and slower transit times common to lateral PNP transistors.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A current sensing circuit, comprising:

a circuit output terminal;

a circuit input terminal;

an output transistor coupled between said circuit output terminal and a terminal for receiving a power supply, and having a gate input coupled to said circuit input terminal for enabling the output transistor;

a replicator circuit comprising a cross-coupled quad circuit coupled to said circuit output terminal and to a reference voltage node and having an output for producing a replicate output current; and a second transistor coupled between said reference voltage node and said power supply, and having a control terminal coupled to a voltage source for generating a voltage proportional to the current flowing in said second transistor;

wherein said replicate output current is proportional to the product of the current flowing in said output transistor multiplied by a ratio comprising the device size of said second transistor over the device size of said output transistor; wherein said replicator circuit comprises:

a first terminal for receiving a current;

a second terminal coupled to said replicate output current;

a first bipolar transistor having a collector and a base coupled together and to said first terminal, and having an emitter coupled to a first cross-coupling node;

a second bipolar transistor having a collector coupled to said second terminal, having a base coupled to the base of said first transistor, and having an emitter coupled to a second cross-coupling node;

a third bipolar transistor having a collector coupled to said first cross coupling node and having a base coupled to said second cross-coupling node, and having its emitter coupled to said circuit output terminal; and a fourth bipolar transistor having a base coupled to said first cross coupling node and a collector coupled to said second cross-coupling node, and having its emitter coupled to said voltage reference node;

wherein the cross-coupled quad circuit is formed from said first, second, third and fourth bipolar transistors which have equal emitter areas.

2. The current sensing circuit of claim 1, wherein said second transistor and said output driving transistor are both MOS transistors fabricated with the same process parameters, and the replicate output current is Iout=$((W/L)_{M2}/(W/L)_{M1})$ IL, where $(W/L)_{M1}$ is the width to length ratio of the output driving transistor M1, $(W/L)_{M2}$ is the width to length ratio of second transistor M2, and the current IL is the current flowing in the output transistor M1.

3. The circuitry of claim 1, wherein each of the bipolar transistors is an NPN transistor.

4. The circuitry of claim 3, wherein the output transistor is configured as a low side driver.

5. The circuitry of claim 1, wherein each of the bipolar transistors is a PNP transistor.

6. The circuitry of claim 5, wherein the output transistor is configured as a high side driver.

7. The circuitry of claim 1, wherein the second transistor is an NMOS transistor.

8. The circuitry of claim 1, wherein the second transistor is a PMOS transistor.

9. The circuitry of claim 1, wherein the output transistor is an NMOS transistor.

10. The circuitry of claim 1, wherein the output transistor is a PMOS transistor.

11. A current limiting circuit, comprising:

a circuit output terminal;

a circuit input terminal;

an output transistor coupled between said circuit output terminal and a terminal for receiving a power supply, and having a gate input for enabling the output transistor;

a set reset circuit having an output coupled to said gate input of said output transistor and having a set input coupled to said circuit input terminal, and having a reset input;

a replicator circuit comprising a cross-coupled quad circuit coupled to said circuit output terminal and to a reference voltage node and having a compare output coupled to said reset terminal of said set reset circuit; and a current source which is coupled to the replicator circuit and produces a fixed reference current;

a second transistor coupled between said reference voltage node and said power supply, and having a control terminal connected to a voltage source for outputting a voltage on said reference voltage node proportional to the current flowing in said second transistor;

wherein said set reset circuit enables the output transistor responsive to a pulse at said circuit input terminal, and said replicator circuit resets said set reset circuit when the current flowing in said second transistor exceeds said fixed reference current.

12. The current limiting circuit of claim 11, wherein said replicator circuit comprises:

a first terminal for receiving a current;

a second terminal for receiving said reference current;

a first bipolar transistor having a collector and a base coupled together and to said first terminal, and having an emitter coupled to a first cross coupling node;

a second bipolar transistor having a collector coupled to said second terminal and to said compare output, having a base coupled to the base of said first transistor, and having an emitter coupled to a second cross coupling node;

a third bipolar transistor having a collector coupled to said first cross coupling node and having a base coupled to said second cross coupling node, and having its emitter coupled to said voltage reference node; and a fourth bipolar transistor having a base coupled to said first cross coupling node and a collector coupled to said second cross coupling node, and having its emitter coupled to said circuit output terminal;

wherein the cross coupled quad circuit is formed from said first, second, third and fourth bipolar transistors which have equal emitter areas.

13. The comparator of claim 12, wherein said second transistor and said output driving transistor are both MOS transistors fabricated with the same process parameters, and the threshold current for the replicator circuit is Iout=$((W/L)_{M2}/(W/L)_{M1})$IL, where $(W/L)_{M1}$ is the width to length ratio of the output driving transistor M1,$(W/L)_{M2}$ is the width to length ratio of the second transistor M2, and the current IL is the current flowing in the output transistor M1.

14. The circuitry of claim 11, wherein each of the bipolar transistors is an NPN transistor.

15. The circuitry of claim 14, wherein the output transistor is configured as a low side driver.

16. The circuitry of claim 11, wherein each of the bipolar transistors is a PNP transistor.

17. The circuitry of claim 16, wherein the output transistor is configured as a high side driver.

18. The circuitry of claim 11, wherein the second transistor is an NMOS transistor.

19. The circuitry of claim 11, wherein the output transistor is an NMOS transistor.

20. The circuitry of claim 11, wherein the output transistor is a PMOS transistor.

21. The circuitry of claim 11, wherein the second transistor is a PMOS transistor.

22. A method for providing a current sensing current, comprising the steps of:

providing an output transistor coupling a circuit output terminal and a power supply terminal, responsive to a gate input;

providing a second transistor coupled between a reference voltage node and a power supply terminal and having a control terminal coupled to a voltage source;

providing a cross-coupled quad replicator circuit coupled to said second transistor and to the circuit output terminal and having an output for producing a replicate current proportional to the current flowing in said output transistor; and operating said output transistor to supply current in a load, the current flowing in said second transistor generating a voltage proportional to the current flowing in said output transistor, and designing said cross coupled quad replicator circuit to output a replicate current proportional to the current flowing in said output transistor; wherein said step of providing a cross-coupled quad replicator circuit comprises the steps of:

providing a first terminal for receiving a current;

providing a second terminal for outputting said replicate output current;

providing a first bipolar transistor having a collector and a base coupled together and to said first terminal, and having an emitter coupled to a first cross-coupling node;

providing a second bipolar transistor having a collector coupled to said second terminal, having a base coupled to the base of said first transistor, and having an emitter coupled to a second cross-coupling node;

providing a third bipolar transistor having a collector coupled to said first cross coupling node and having a base coupled to said second cross-coupling node and an emitter coupled to said voltage reference node;

providing a fourth bipolar transistor having a base coupled to said first cross-coupling node and a collector coupled to said second cross-coupling node, and having its emitter coupled to said circuit output terminal; and wherein said first, second, third and fourth bipolar transistors each have equal emitter areas.

23. The method of claim 22, wherein said replicate output current is proportional to the product of the current flowing in said output transistor multiplied by the ratio of the width to length ratio of the second transistor over the width to length ratio of said output transistor.

24. A method of providing a current limiting circuit, comprising the steps of:

providing an output transistor coupling a circuit output terminal to a power supply terminal responsive to a gate input terminal;

providing a set reset circuit coupled to said gate input terminal and having a set input terminal coupled to a circuit input terminal for enabling said output transistor responsive to said circuit input terminal, said set reset circuit having a reset input terminal;

providing a replicator circuit comprising a cross-coupled quad circuit coupled to said circuit output terminal and to a voltage reference node, and having an output coupled to said reset input terminal;

providing a current source coupled to said replicator circuit and to said reset input terminal for supplying a predetermined current;

providing a second transistor coupled to said voltage reference node and having a control terminal connected to a voltage source for producing a voltage at said voltage reference node;

operating said second transistor and said replicator circuit so that when the voltage across the second transistor reaches a predetermined threshold indicating the current flowing in said second transistor is exceeding said predetermined current, the replicator circuit will assert a voltage on said reset terminal of said set reset circuit and thereby disable said output transistor.

25. The method of claim 24, wherein said step of providing a replicator circuit comprises the steps of:

providing a first terminal for receiving a current;

providing a second terminal for receiving a current;

providing a first bipolar transistor having a collector and a base coupled together and to said first terminal, and having an emitter coupled to a first cross coupling node;

providing a second bipolar transistor having a collector coupled to said second terminal and to said output, having a base coupled to the base of said first transistor, and having an emitter coupled to a second cross coupling node;

providing a third bipolar transistor having a collector coupled to said first cross coupling node and having a base coupled to said second cross coupling node, and having its emitter coupled to said voltage reference node;

providing a fourth bipolar transistor having a base coupled to said first cross coupling node and a collector coupled to said second cross coupling node, and having its emitter coupled to said circuit output terminal; and designing the cross coupled quad circuit formed from said first, second, third and fourth bipolar transistors such that said bipolar transistors each have equal emitter areas.

26. The method of claim 24, wherein said predetermined threshold is proportional to the product of the current flowing in said output transistor multiplied by the ratio of the width to length ratio of the output transistor over the width to length ratio of the second transistor.

* * * * *